US008450942B2

(12) United States Patent
Tseng

(10) Patent No.: US 8,450,942 B2
(45) Date of Patent: May 28, 2013

(54) LIGHT EMITTING DIODE DRIVING APPARATUS

(75) Inventor: Yang-Tai Tseng, Hsinchu (TW)

(73) Assignee: Power Forest Technology Corporation, Hsinchu (TW)

( * ) Notice: Subject to any disclaimer, the term of this patent is extended or adjusted under 35 U.S.C. 154(b) by 300 days.

(21) Appl. No.: 13/069,381

(22) Filed: Mar. 23, 2011

(65) Prior Publication Data

US 2012/0206055 A1 Aug. 16, 2012

(30) Foreign Application Priority Data

Feb. 15, 2011 (TW) ..... 100104923 A

(51) Int. Cl.
*H05B 37/02* (2006.01)

(52) U.S. Cl.
USPC ..... 315/291; 315/294; 315/307; 315/312

(58) Field of Classification Search
USPC ..... 315/224, 291, 294, 307, 312
See application file for complete search history.

(56) References Cited

U.S. PATENT DOCUMENTS

2008/0068298 A1* 3/2008 Shen et al. ..... 345/46
2008/0315773 A1* 12/2008 Pang ..... 315/151
2009/0295776 A1* 12/2009 Yu et al. ..... 345/212
2012/0074868 A1* 3/2012 Tseng et al. ..... 315/294

* cited by examiner

*Primary Examiner* — Jason M Crawford
(74) *Attorney, Agent, or Firm* — Jianq Chyun IP Office

(57) ABSTRACT

A light-emitting-diode (LED) driving apparatus is provided, and which includes a power switch having a first terminal coupled to a first node and a second terminal coupled to a second node, wherein an LED string is coupled between a DC voltage and the first node; a first resistor coupled between the second node and a ground potential; and a control chip for generating a driving signal in response to a voltage on the second node and a bandgap voltage during an activation phase of the LED driving apparatus, so as to switch the power switch and thus making the LED string to be operated under a constant current for producing light, and further comparing a detection voltage obtained in response to a voltage on the first node with a predetermined voltage, so as to stop generating the driving signal when the detection voltage is greater than the predetermined voltage.

8 Claims, 4 Drawing Sheets

LIGHT EMITTING DIODE DRIVING APPARATUS

CROSS-REFERENCE TO RELATED APPLICATION

This application claims the priority benefit of Taiwan application serial no. 100104923, filed on Feb. 15, 2011. The entirety of the above-mentioned patent application is hereby incorporated by reference herein and made a part of this specification.

BACKGROUND OF THE INVENTION

1. Field of the Invention

The present invention relates to a light emitting diode (LED) driving technology, more particularly, to an LED driving apparatus with protection function.

2. Description of the Related Art

FIG. 1 is a diagram of a conventional LED driving apparatus 10. Referring to FIG. 1, the LED driving apparatus 10 is suitable for driving the LED string 101 including a plurality of LEDs L connected in series. The LED driving apparatus 10 includes a control chip 103, an external circuit 105, a power switch Q and a resistor Rcs. The control chip 103 is used for generating a driving signal $V_{PW}$ in response to the voltage Vcs on the node N2, so as to switch the power switch Q, and thus making the LED string 101 to be operated under a constant current for producing light.

The external circuit 105 is composed of a Zener diode ZD, a resistor R, a capacitor C and a comparator CMP. During an activation phase of the LED driving apparatus 10, the Zener diode ZD, the resistor R and the capacitor C are used for detecting the voltage $V_D$ on the node N1, so as to generate a detection voltage $V_{SLP}$. When the DC voltage $V_{BUS}$ is greater than the voltage value Vz of the Zener diode ZD, the value of the detection voltage $V_{SLP}$ is equal to Iz*R (i.e. $V_{SLP}$=Iz*R), where Iz is a current flowing through the Zener diode ZD, and R is the resistance of the resistor R.

Meanwhile, once the comparator CMP compares that the detection voltage $V_{SLP}$ is greater than the predetermined $V_{SET}$, namely, a part of or all of LEDs L in the LED string 101 are short circuited, the comparator CMP would output a fault signal FS to the control chip 103, so as to make the control chip 103 stop generating the driving signal $V_{PW}$, and thus protecting the control chip 103 and the power switch Q from damage due to a high voltage (i.e. the DC voltage $V_{BUS}$).

However, the structure of the conventional LED driving apparatus 10 has some problems as below.

1. In some situations, for example, all of LEDs L in the LED string 101 are short circuited, or the power switch Q is turned off during the shut-down phase of the LED driving apparatus 10, the voltage $V_D$ on the node N1 would be higher (a couple of hundred volts). In such case, the Zener diode ZD must be used to block the high voltage (i.e. the DC voltage $V_{BUS}$) to protect the comparator CMP and/or the control chip 103 both with low voltage process.

2. The voltage value Vz of the Zener diode ZD must be changed with the DC voltage $V_{BUS}$, for example, when the DC voltage $V_{BUS}$ is 200 volts, the voltage value Vz of the Zener diode ZD must be 200 volts, and so on. Therefore, the Zener diode ZD cannot be integrated with the control chip 103 in the structure of the conventional LED driving apparatus 10.

SUMMARY OF THE INVENTION

Accordingly, the present invention is directed to an LED driving apparatus, so as to solve the problems of the prior art.

The present invention provides an LED driving apparatus which is suitable for driving at least an LED string. The LED driving apparatus includes a power switch, a first resistor and a control chip. A first terminal of the power switch is coupled to a first node, and a second terminal of the power switch is coupled to a second node. The LED string is coupled between a DC voltage and the first node. The first resistor is coupled between the second node and a ground potential. The control chip is coupled to a control terminal of the power switch, the first node and the second node. The control chip is used for generating a driving signal in response to a voltage on the second node and a bandgap voltage during an activation phase of the LED driving apparatus, so as to switch the power switch and thus making the LED string to be operated under a constant current for producing light, and further for comparing a detection voltage obtained in response to a voltage on the first node with a predetermined voltage, so as to stop generating the driving signal when the detection voltage is greater than the predetermined voltage.

In one embodiment of the present invention, the control chip is further used for limiting a current flowing through the LED string during a shut-down phase of the LED driving apparatus, so as to make the LED string stop producing light.

In one embodiment of the present invention, the control chip includes a driving unit, a detection unit and a control body. The driving unit is coupled to the control terminal of the power switch and the second node. The driving unit is used for comparing the voltage on the second node with the bandgap voltage in response to a control signal during the activation phase of the LED driving apparatus, so as to generate the driving signal accordingly for switching the power switch, and thus making the LED string to be operated under the constant current for producing light. The detection unit is couple to the first node, and used for detecting the voltage on the first node in response to an enablement signal during the activation phase of the LED driving apparatus, so as to obtain the detection voltage and then compare the detection voltage with the predetermined voltage, wherein when the detection voltage is greater than the predetermined voltage, the detection unit outputs a fault signal. The control chip is coupled to the driving unit and the detection unit, and used for generating the control signal and the enablement signal to respectively control operations of the driving unit and the detection unit, and further used for controlling the driving unit to stop generating the driving signal in response to the fault signal.

In one embodiment of the present invention, the detection unit is further used for limiting the current flowing through the LED string in response to the enablement signal during the shut-down phase of the LED driving apparatus, so as to make the LED string stop producing light.

In one embodiment of the present invention, the detection unit includes a first and a second transistors, a second through a fourth resistors, and a comparator. A drain of the first transistor is coupled to the first node, and a body of the first transistor is used for receiving a reference voltage. A gate of the second transistor is used for receiving the enablement signal, a drain of the second transistor is coupled to a gate of the first transistor, and a source of the second transistor is coupled to the ground potential. A first terminal of the second resistor is coupled to a source of the first transistor, and a second terminal of the second resistor is used for generating the detection voltage. A first terminal of the third resistor is coupled to the second terminal of the second resistor, and a second terminal of the third resistor is coupled to the ground potential. A first terminal of the fourth resistor is coupled to the gate of the first transistor, and a second terminal of the fourth resistor is coupled to the source of the first transistor. A first input terminal of the comparator is coupled to the second terminal of the second resistor for receiving the detection voltage, a second input terminal of the comparator is used for receiving the predetermined voltage, and an output terminal of the comparator is used for outputting the fault signal. In this case, the first transistor is an N-channel depletion-type metal oxide semiconductor field effect transistor (MOSFET), and the second transistor is an N-channel enhancement-type MOSFET.

In another embodiment of the present invention, the detection unit includes a first through a sixth transistors, a second through a fifth resistors, and a comparator. A drain of the first transistor is coupled to the first node, and a body of the first transistor is used for receiving a reference voltage. A gate of the second transistor is used for receiving the enablement signal, a drain of the second transistor is coupled to a gate of the first transistor, and a source of the second transistor is coupled to the ground potential. A first terminal of the second resistor is coupled to a source of the first transistor, and a first terminal of the third resistor is coupled to a second terminal of the second resistor. A first terminal of the fourth resistor is coupled to the gate of the first transistor, and a second terminal of the fourth resistor is coupled to the source of the first transistor. A gate and a drain of the third transistor are coupled to a second terminal of the third resistor, and a source of the third transistor is coupled to the ground potential. A gate of the fourth transistor is coupled to the gate of the third transistor, and a source of the fourth transistor is coupled to the ground potential. A source of the fifth transistor is coupled to a system voltage, and a gate and a drain of the fifth transistor are coupled to a drain of the fourth transistor. A source of the sixth transistor is coupled to the system voltage, and a gate of the sixth transistor is coupled to the gate of the fifth transistor. A first terminal of the fifth resistor is coupled to a drain of the sixth transistor for generating the detection voltage, and a second terminal of the fifth resistor is coupled to the ground potential. A first input terminal of the comparator is coupled to the first terminal of the fifth resistor for receiving the detection voltage, a second input terminal of the comparator is used for receiving the predetermined voltage, and an output terminal of the comparator is used for outputting the fault signal. In this case, the first transistor is an N-channel depletion-type MOSFET; the second through the fourth transistors are N-channel enhancement-type MOSFETs; and the fifth and the sixth transistors are P-channel enhancement-type MOSFETs.

From the above, in the LED driving apparatus of present invention, the detection unit is designed by the characteristic of the depletion-type MOSFET, so as to protect the control chip and the power switch from damage due to a high voltage (i.e. the DC voltage $V_{BUS}$). And, the structure of the designed detection unit does not to be changed with the operation voltage of the LED string (i.e. the DC voltage $V_{BUS}$), such that the designed detection unit can be suitably integrated with the control chip.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
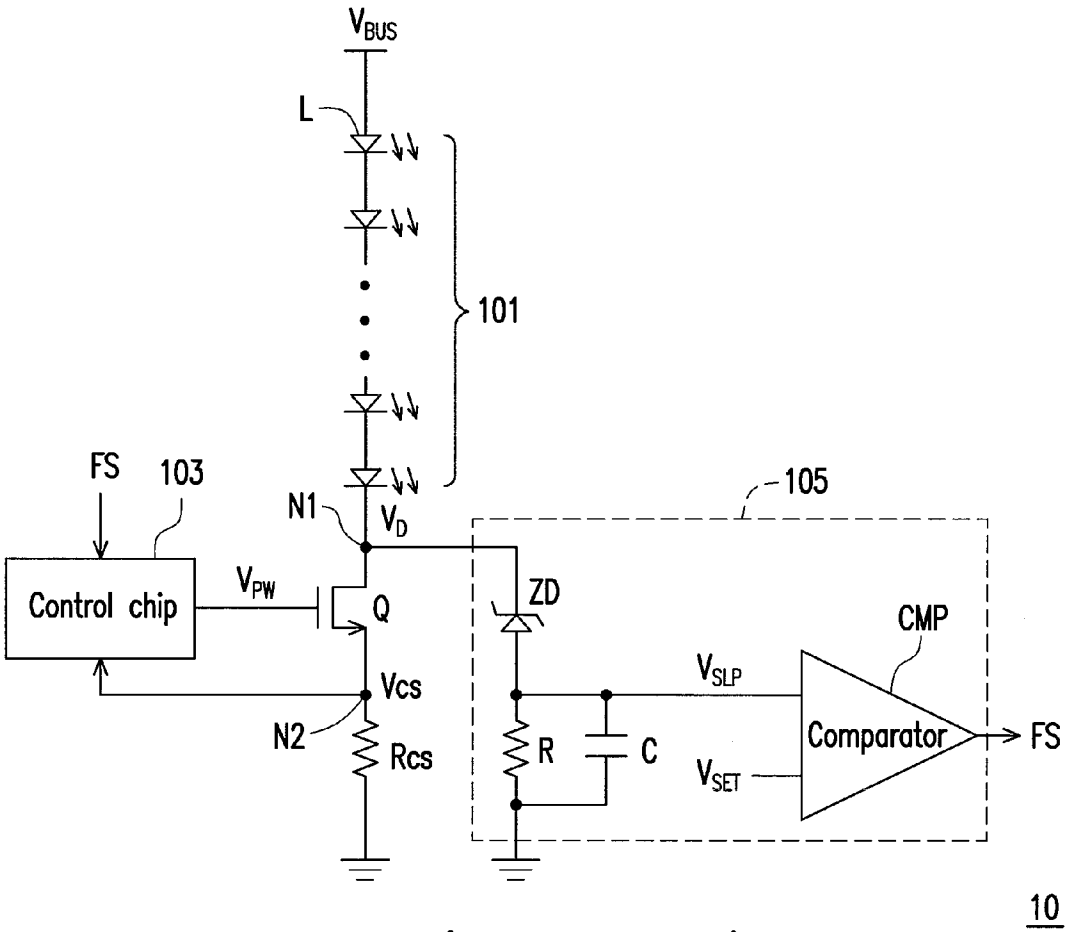
FIG. 1 (PRIOR ART)
FIG. 1 is a diagram of a conventional LED driving apparatus 10.

Reference will now be made in detail to the present preferred embodiments of the invention, examples of which are illustrated in the accompanying drawings. Wherever possible, the same reference numbers are used in the drawings and the description to refer to the same or like parts.

Figure 2:
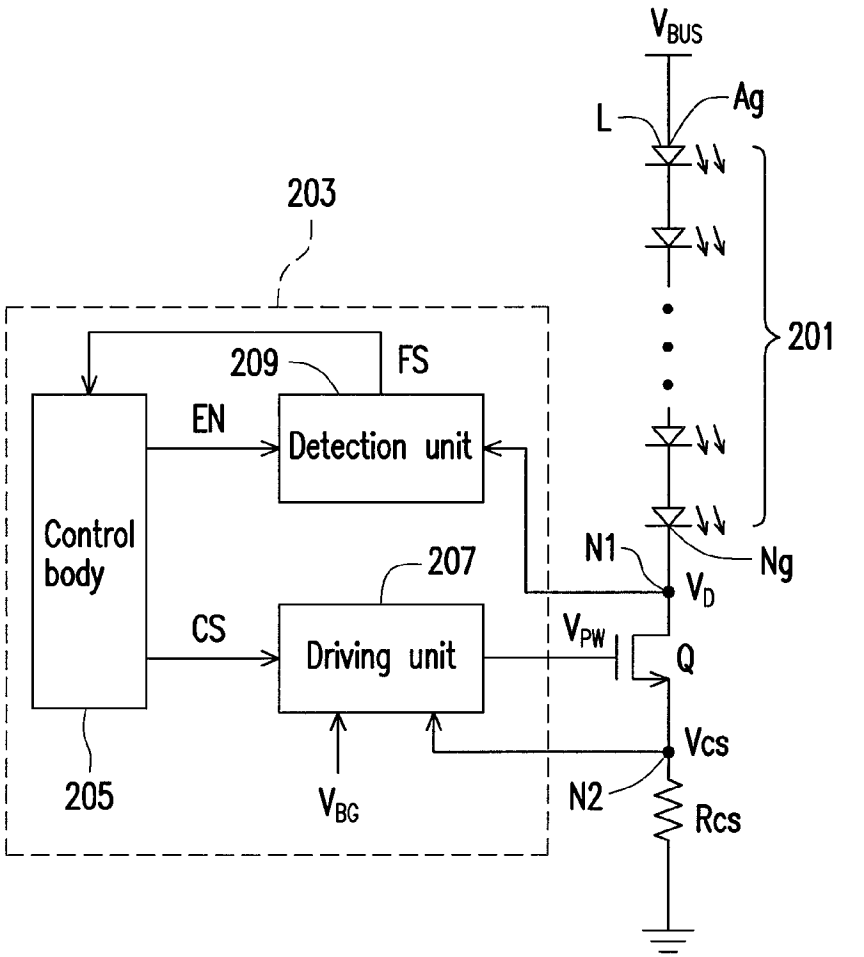
FIG. 2 is a diagram of an LED driving apparatus 20 according to an embodiment of the present invention.

FIG. 2 is a diagram of an LED driving apparatus 20 according to an embodiment of the present invention. Referring to FIG. 2, the LED driving apparatus 20 is suitable for driving at least an LED string 201 including a plurality of LEDs L connected in series. The LED driving apparatus 20 includes a power switch Q, a resistor Rcs and a control chip 203.

In the present embodiment, a first terminal of the power switch Q is coupled to a node N1, and a second terminal of the power switch Q is coupled to a node N2. The LED string 201 is coupled between a DC voltage $V_{BUS}$ and the node N1, namely, an anode Ad of the LED string 201 is coupled to the DC voltage $V_{BUS}$, and a cathode Ng of the LED string 201 is coupled to the node N1. The resistor Rcs is coupled between the node N2 and a ground potential. The control chip 203 is coupled to a control terminal of the power switch Q and the nodes N1 and N2. The control chip 203 is used for generating a driving signal $V_{PW}$ in response to a voltage Vcs on the node N2 and a bandgap voltage $V_{BG}$ during an activation phase of the LED driving apparatus 20, so as to switch the power switch Q and thus making the LED string 201 to be operated under a constant current for producing light, wherein the value of the bandgap voltage $V_{BG}$ is used for determining a current flowing through the LED string 201.

In addition, the control chip 203 is further used for comparing a detection voltage (e.g. $V_{SLP}$ shown in FIGS. 3A and 3B) obtained in response to a voltage $V_D$ on the node N1 with a predetermined voltage (e.g. $V_{SET}$ shown in FIGS. 3A and 3B), so as to stop generating the driving signal $V_{PW}$ when the detection voltage $V_{SLP}$ is greater than the predetermined voltage $V_{SET}$. Furthermore, the control chip 203 is further used for limiting the current flowing through the LED string 201 during a shut-down phase of the LED driving apparatus 20, so as to make the LED string 201 stop producing light.

To be specific, the control chip 203 may include a control body 205, a driving unit 207 and a detection unit 209. The control body 205 is coupled to the driving unit 207 and the detection unit 209, and used for generating a control signal CS and an enablement signal EN to respectively control the operations of the driving unit 207 and the detection unit 209.

The driving unit 207 is coupled to the control terminal of the power switch Q and the node N2. The driving unit 207 is used for comparing the voltage Vcs on the node N2 with the bandgap voltage $V_{BG}$ in response to the control signal CS (e.g. logic "1") generated by the control body 205 during the activation phase of the LED driving apparatus 20, so as to generate the driving signal $V_{PW}$ accordingly for switching the power switch Q, and thus making the LED string 201 to be operated under the constant current for producing light.

The detection unit 209 is couple to the node N1, and used for detecting the voltage $V_D$ on the node N1 in response to the enablement signal EN (e.g. logic "0") generated by the control body 205 during the activation phase of the LED driving apparatus 20, so as to obtain the detection voltage $V_{SLP}$ and then compare the detection voltage $V_{SLP}$ with the predetermined voltage $V_{SET}$, wherein when the detection voltage $V_{SLP}$ is greater than the predetermined voltage $V_{SET}$, the detection unit 209 outputs a fault signal FS to the control body 205. Accordingly, the control body 205 would generate the control signal CS (e.g. logic "0") in response to the fault signal FS outputted by the detection unit 209, so as to control the driving unit 207 to stop generating the driving signal $V_{PW}$. Moreover, the detection unit 209 is further used for limiting the current flowing through the LED string 201 in response to the enablement signal EN (e.g. logic "1") generated by the control body 205 during the shut-down phase of the LED driving apparatus 20, so as to make the LED string 201 stop producing light.

Figure 3A:
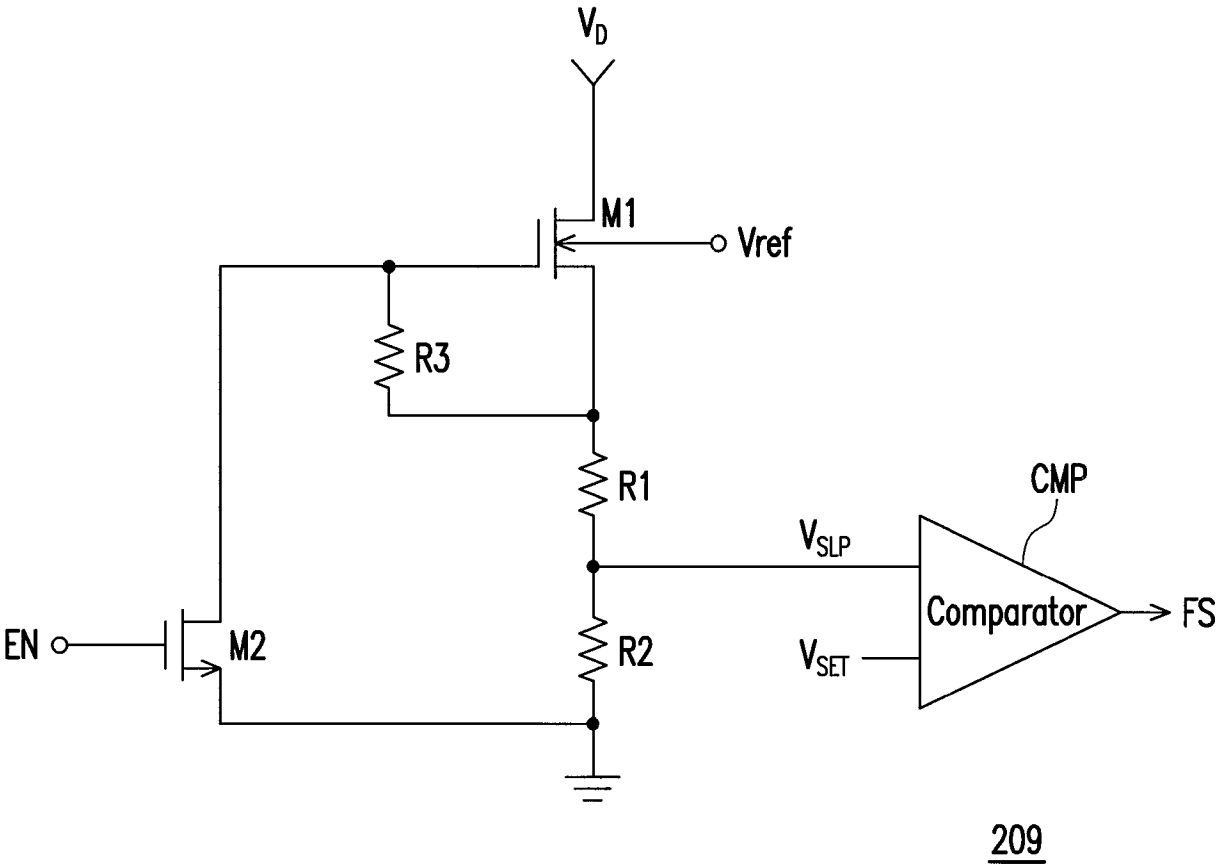
FIG. 3A is a circuit diagram of a detection unit 209 according to an embodiment of the present invention.

Here, FIG. 3A is a circuit diagram of the detection unit 209 according to an embodiment of the present invention. Referring to FIGS. 2 and 3A, the detection unit 209 shown in FIG. 3A includes a high voltage N-channel depletion-type metal oxide semiconductor field effect transistor (MOSFET) M1 (hereinafter "transistor M1"), an N-channel enhancement-type MOSFET M2 (hereinafter "transistor M2"), resistors R1 to R3, and a comparator CMP. A drain of the transistor M1 is coupled to the node N1, and a body of the transistor M1 is used for receiving a reference voltage Vref (e.g. the ground potential, but not limited thereto).

A gate of the transistor M2 is used for receiving the enablement signal EN generated by the control body 205, a drain of the transistor M2 is coupled to a gate of the transistor M1, and a source of the transistor M2 is coupled to the ground potential. A first terminal of the resistor R1 is coupled to a source of the transistor M1, and a second terminal of the resistor R1 is used for generating the detection voltage $V_{SLP}$. A first terminal of the resistor R2 is coupled to the second terminal of the resistor R1, and a second terminal of the resistor R2 is coupled to the ground potential. A first terminal of the resistor R3 is coupled to the gate of the transistor M1, and a second terminal of the resistor R3 is coupled to the source of the transistor M1. A first input terminal of the comparator CMP is coupled to the second terminal of the resistor R1 for receiving the detection voltage $V_{SLP}$, a second input terminal of the comparator CMP is used for receiving the predetermined voltage $V_{SET}$, and an output terminal of the comparator CMP is used for outputting the fault signal FS.

Figure 3B:
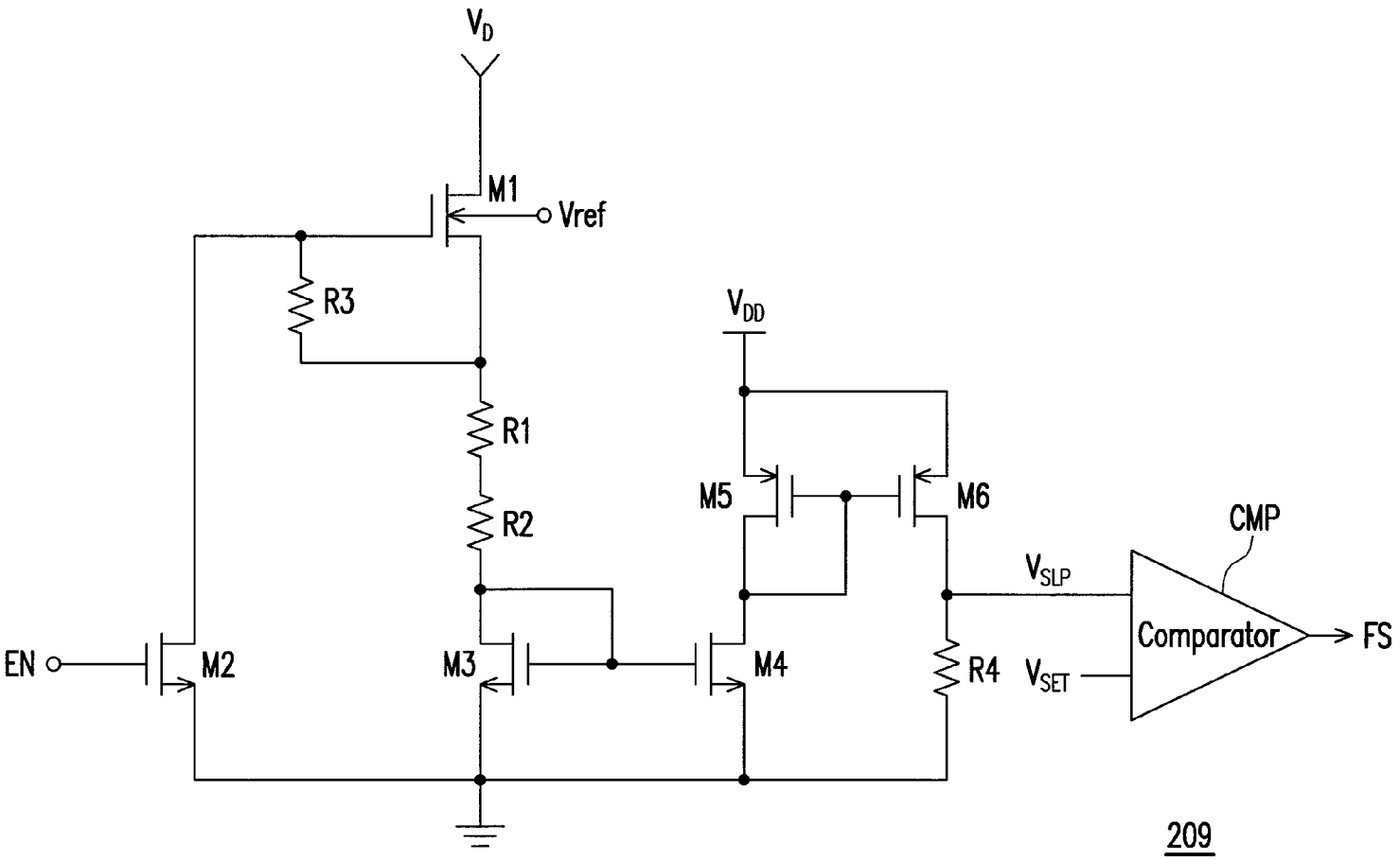
FIG. 3B is a circuit diagram of a detection unit 209 according to another embodiment of the present invention.

In the other hands, FIG. 3B is a circuit diagram of the detection unit 209 according to another embodiment of the present invention. Referring to FIGS. 2, 3A and 3B, the detection unit 209 shown in FIG. 3B includes a high voltage N-channel depletion-type MOSFET M1 (hereinafter "transistor M1"), N-channel enhancement-type MOSFETs M2 to M4 (hereinafter "transistors M2 to M4"), P-channel enhancement-type MOSFETs M5 and M6 (hereinafter "transistors M5 and M6"), resistors R1 to R4, and a comparator CMP. A drain of the transistor M1 is coupled to the node N1, and a body of the transistor M1 is used for receiving a reference voltage Vref (e.g. the ground potential, but not limited thereto).

A gate of the transistor M2 is used for receiving the enablement signal EN generated by the control body 205, a drain of the transistor M2 is coupled to a gate of the transistor M1, and a source of the transistor M2 is coupled to the ground potential. A first terminal of the resistor R1 is coupled to a source of the transistor M1, and a first terminal of the resistor R2 is coupled to a second terminal of the resistor R1. A first terminal of the resistor R3 is coupled to the gate of the transistor M1, and a second terminal of the resistor R3 is coupled to the source of the transistor M1. A gate and a drain of the transistor M3 are coupled to a second terminal of the resistor R2, and a source of the transistor M3 is coupled to the ground potential. A gate of the transistor M4 is coupled to the gate of the transistor M3, and a source of the transistor M4 is coupled to the ground potential. A source of the transistor M5 is coupled to a system voltage $V_{DD}$, and a gate and a drain of the transistor M5 are coupled to a drain of the transistor M4.

A source of the transistor M6 is coupled to the system voltage $V_{DD}$, and a gate of the transistor M6 is coupled to the gate of the transistor M5. A first terminal of the resistor R4 is coupled to a drain of the transistor M6 for generating the detection voltage $V_{SLP}$, and a second terminal of the resistor R4 is coupled to the ground potential. A first input terminal of the comparator CMP is coupled to the first terminal of the resistor R4 for receiving the detection voltage $V_{SLP}$, a second input terminal of the comparator CMP is used for receiving the predetermined voltage $V_{SET}$, and an output terminal of the comparator CMP is used for outputting the fault signal FS.

From the above, during the activation phase of the LED driving apparatus 20, the control body 205 would generate the control signal CS with logic "1" to the driving unit 207, so as to make the driving unit 207 compare the voltage Vcs on the node N2 with the bandgap voltage $V_{BG}$, and then generate the driving signal $V_{PW}$ to switch the power switch Q. Accordingly, the LED string 201 may be operated under the constant current for producing light. Meanwhile, the control body 205 would generate the enablement signal EN with logic "0" to the detection unit 209, so as to turn off the transistor M2. Accordingly, at this time, since the voltage (Vsource) of the source of the transistor M1 is less than the pinch-off voltage (Vpinch_dep) of the transistor M1, and the voltage (Vdrain) of the drain of the transistor M1 is approximately equal to the voltage (Vsource) of the source of the transistor M1, so the detection voltages $V_{SLP}$ shown in FIGS. 3A and 3B can be respectively represented as equations 1 and 2.

$$V_{SLP}=V_{source}*R2/(R1+R2) \quad 1$$

$$V_{SLP}=V_{source}*R4/(R1+R2) \quad 2$$

Where R1, R2 and R4 are respectively corresponding to the resistances of the resistors R1, R2 and R4.

Once the comparator CMP compares that the detection voltage $V_{SLP}$ is greater than the predetermined voltage $V_{SET}$, namely, a part of or all of LEDs L in the LED string 201 are short circuited, the comparator CMP would output the fault signal FS to the control body 205. Accordingly, the control body 205 would generate the control signal CS with logic "0" to control the driving unit 207 to stop generating the driving signal $V_{PW}$, and thus protecting the control chip 203 and the power switch Q from damage due to the high DC voltage $V_{BUS}$.

In the other hands, during the shut-down phase of the LED driving apparatus 20, the control body 205 would generate the enablement signal EN with logic "1" to the detection unit 209, so as to turn on the transistor M2. Accordingly, since the voltage (Vdrain) of the drain of the transistor M1 is equal to the DC voltage $V_{BUS}$, and the voltage (Vsource) of the source of the transistor M1 is approximately equal to the pinch-off voltage (Vpinch_dep) of the transistor M1, so the current ($I_{LED}$) flowing through the LED string 201 can be represented as equation 3.

$$I_{LED}=V\text{pinch_dep}/R3 \quad 3$$

Where R3 is corresponding to the resistance of the resistor R3.

In this case, the current ($I_{LED}$) flowing through the LED string 201 is smaller and smaller due to increasing the resistance of the resistor R3. Accordingly, the current ($I_{LED}$) flowing through the LED string 201 can be limited by substantially increasing the resistance of the resistor R3 during the shut-down phase of the LED driving apparatus 20, and thus making the LED string 201 stop producing light due to the current flowing through the LED string 201 is lower than the minimum turn-on current of the LED string 201.

From the above, it is known that, in the present embodiment, the transistor M1 is used to block the high voltage (i.e. the DC voltage $V_{BUS}$) for protecting the comparator CMP and/or the control chip 203 with low-voltage process. In addition, in the present embodiment, the pinch-off voltage (Vpinch_dep) of the transistor M1 can be changed by changing the reference voltage Vref received by the body of the transistor M1, so as to fit the requirements of actual applications.

In summary, in the LED driving apparatus 20 of present invention, the detection unit 209 is designed by the characteristic of the depletion-type MOSFET M1, so as to protect the control chip 203 and the power switch Q from damage due to the high voltage (i.e. the DC voltage $V_{BUS}$). And, the structure of the designed detection unit 209 does not to be changed with the operation voltage of the LED string 201 (i.e. the DC voltage $V_{BUS}$), such that the designed detection unit 209 can be suitably integrated with the control chip 203.

It will be apparent to those skills in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light emitting diode (LED) driving apparatus, suitable for driving at least an LED string, and the LED driving apparatus comprising:

a power switch, having a first terminal coupled to a first node and a second terminal coupled to a second node, wherein the LED sting is coupled between a DC voltage and the first node;

a first resistor, coupled between the second node and a ground potential; and a control chip, coupled to a control terminal of the power switch, the first node and the second node, for generating a driving signal in response to a voltage on the second node and a bandgap voltage during an activation phase of the LED driving apparatus, so as to switch the power switch and thus making the LED string to be operated under a constant current for producing light, and further for comparing a detection voltage obtained in response to a voltage on the first node with a predetermined voltage, so as to stop generating the driving signal when the detection voltage is greater than the predetermined voltage.

2. The LED driving apparatus according to claim 1, wherein the control chip is further for limiting a current flowing through the LED string during a shut-down phase of the LED driving apparatus, so as to make the LED string stop producing light.

3. The LED driving apparatus according to claim 2, wherein the control chip comprises:

a driving unit, coupled to the control terminal of the power switch and the second node, for comparing the voltage on the second node with the bandgap voltage in response to a control signal during the activation phase of the LED driving apparatus, so as to generate the driving signal accordingly for switching the power switch, and thus making the LED string to be operated under the constant current for producing light;

a detection unit, couple to the first node, for detecting the voltage on the first node in response to an enablement signal during the activation phase of the LED driving apparatus, so as to obtain the detection voltage and then compare the detection voltage with the predetermined voltage, wherein when the detection voltage is greater than the predetermined voltage, the detection unit outputs a fault signal; and a control body, coupled to the driving unit and the detection unit, for generating the control signal and the enablement signal to respectively control operations of the driving unit and the detection unit, and further for controlling the driving unit to stop generating the driving signal in response to the fault signal.

4. The LED driving apparatus according to claim 3, wherein the detection unit is further for limiting the current flowing through the LED string in response to the enablement signal during the shut-down phase of the LED driving apparatus, so as to make the LED string stop producing light.

5. The LED driving apparatus according to claim 4, wherein the detection unit comprises:

a first transistor, having a drain coupled to the first node and a body receiving a reference voltage;

a second transistor, having a gate receiving the enablement signal, a drain coupled to a gate of the first transistor and a source coupled to the ground potential;

a second resistor, having a first terminal coupled to a source of the first transistor and a second terminal generating the detection voltage;

a third resistor, having a first terminal coupled to the second terminal of the second resistor and a second terminal coupled to the ground potential;

a fourth resistor, having a first terminal coupled to the gate of the first transistor and a second terminal coupled to the source of the first transistor; and a comparator, having a first input terminal coupled to the second terminal of the second resistor for receiving the detection voltage, a second input terminal receiving the predetermined voltage and an output terminal outputting the fault signal.

6. The LED driving apparatus according to claim 5, wherein the first transistor is an N-channel depletion-type metal oxide semiconductor field effect transistor (MOSFET); and the second transistor is an N-channel enhancement-type MOSFET.

7. The LED driving apparatus according to claim 4, wherein the detection unit comprises:

a first transistor, having a drain coupled to the first node and a body receiving a reference voltage;

a second transistor, having a gate receiving the enablement signal, a drain coupled to a gate of the first transistor and a source coupled to the ground potential;

a second resistor, having a first terminal coupled to a source of the first transistor;

a third resistor, having a first terminal coupled to a second terminal of the second resistor;

a fourth resistor, having a first terminal coupled to the gate of the first transistor and a second terminal coupled to the source of the first transistor;

a third transistor, having a gate and a drain both coupled to a second terminal of the third resistor and a source coupled to the ground potential;

a fourth transistor, having a gate coupled to the gate of the third transistor and a source coupled to the ground potential;

a fifth transistor, having a source coupled to a system voltage and a gate and a drain both coupled to a drain of the fourth transistor;

a sixth transistor, having a source coupled to the system voltage and a gate coupled to the gate of the fifth transistor;

a fifth resistor, having a first terminal coupled to a drain of the sixth transistor for generating the detection voltage and a second terminal coupled to the ground potential; and a comparator, having a first input terminal coupled to the first terminal of the fifth resistor for receiving the detection voltage, a second input terminal receiving the predetermined voltage and an output terminal outputting the fault signal.

8. The LED driving apparatus according to claim 7, wherein the first transistor is an N-channel depletion-type metal oxide semiconductor field effect transistor (MOSFET);

the second through the fourth transistors are N-channel enhancement-type MOSFETs; and the fifth and the sixth transistors are P-channel enhancement-type MOSFETs.

* * * * *